United States Patent [19]

Ichiryu et al.

[11] 4,215,723

[45] Aug. 5, 1980

[54] FLUID PRESSURE SERVO VALVE ASSEMBLY

[75] Inventors: Ken Ichiryu, Mito; Ichiro Nakamura, Katsuta; Katsumasa Matsuura, Hitachi, all of Japan

[73] Assignee: Hitachi, Ltd., Tokyo, Japan

[21] Appl. No.: 801,302

[22] Filed: May 27, 1977

[30] Foreign Application Priority Data

Jun. 11, 1976 [JP] Japan ..... 51-67641

[51] Int. Cl.[2] ..... F15B 13/043

[52] U.S. Cl. ..... 137/625.63; 137/625.64; 137/625.66

[58] Field of Search ..... 137/625.63, 625.64, 137/625.66, 625.6, 625.61, 625.62

[56] References Cited

U.S. PATENT DOCUMENTS

| | | | |
|---|---|---|---|
| 3,434,390 | 3/1969 | Weiss | 137/625.61 X |
| 3,556,154 | 1/1971 | Kramer | 137/625.64 |
| 3,736,958 | 6/1973 | Rostad | 137/625.64 X |
| 3,774,641 | 11/1973 | Mindner et al. | 137/625.64 |
| 3,964,518 | 6/1976 | Hesse et al. | 137/625.64 |
| 4,072,087 | 2/1978 | Mueller | 137/625.66 X |

*Primary Examiner*—Gerald A. Michalsky

*Attorney, Agent, or Firm*—Thomas E. Beall, Jr.

[57] ABSTRACT

A fluid pressure servo valve assembly driven by a pilot servo valve assembly and having a valve body formed therein with a cylindrical bore, input ports and output ports opening in the cylindrical bore, a spool valve member fitted in the cylindrical bore for axial reciprocatory movement and including axially spaced lands for connecting and disconnecting the input ports with the output ports as the spool valve member moves in axial reciprocatory movement in the cylindrical bore, a sealed annular space defined by an annular recess formed in the peripheral surface of the cylindrical bore of the valve body and an outer peripheral surface of one of the lands of the spool valve member, a piston member integrally connected to the outer periphery of the one of the lands of the spool valve member and extending radially outwardly therefrom into the annular space to divide the same into two pressure chambers, and passages for communicating the two pressure chambers with the pilot servo valve assembly. An actuating pressurized fluid is introduced alternately into one or the other of the two pressure chambers from the pilot servo valve assembly so as to cause the spool valve member connected to the piston member to move in axial reciprocatory movement in the cylindrical bore.

6 Claims, 9 Drawing Figures

FLUID PRESSURE SERVO VALVE ASSEMBLY

BACKGROUND OF THE INVENTION

1. Field of the Invention

This invention relates to servo valve systems each including a pilot servo valve assembly and at least one fluid pressure servo valve assembly driven by such pilot servo valve assembly, and more particularly to a fluid pressure servo valve assembly having particular utility in equipment, e.g. a vibration table, requiring a servo valve system that can handle a fluid flow of a large capacity with a high responsiveness.

2. Description of the Prior Art

Heretofore, research into servo valve systems capable of handling a fluid flow of a large capacity (high flow rate), such as 5,000 l/min., has not been popular because of the fact that there is not much commercial value in these systems. Although these systems have had certain applications, what is required in these applications is merely determination of the flow rate, and the requirement for the response is very low, or the limits placed on the operation are several hertz, for example.

However, there has in recent years grow a strong need to cause colossal equipment, equipment for nuclear reactors weighing several thousand tons, for example, to vibrate in order to verify the capability of such equipment to withstand the shock of earthquakes. Thus there has been created a demand for servo valve systems of a large capacity and high responsiveness for effecting control of the operation of causing such equipment to vibrate.

In one system of the prior art to cope with this situation, hydraulic pressure is increased in two or three stages, and a main servo valve assembly including a spool valve member of a large diameter (which is referred to as a power or main spool valve member) of the last stage is driven so as to effect control of a high flow rate. In this type of system, there are provided a pilot servo valve assembly in addition to main servo valve assembly driven by the pilot servo valve assembly. The main servo valve assembly comprises a valve body formed therein with a cylindrical bore, an input port and output ports opening in the cylindrical bore, and a power spool valve member fitted in the cylindrical bore for axial reciprocatory movement. The input port is connected and disconnected with the output ports as the power spool valve member moves in the cylindrical bore for axial reciprocatory movement. The main servo valve assembly further comprises two pressure chambers defined by inner faces of end walls of the valve body and axial end faces of the power spool valve member, and passages for communicating the two pressure chambers with the pilot servo valve assembly. An actuating pressurized fluid introduced from the pilot valve assembly alternately into one or the other of the two pressure chambers acts on the axial end faces of the spool valve member to move the same in axial reciprocatory movement in the cylindrical bore.

In this type of system of the prior art, the passages communicating the pilot servo valve assembly with the two pressure chambers have a large length because the pressure chambers are disposed on the axial ends of the cylindrical bore formed in the main servo valve assembly. This means that the volume of the passages is increased, so that a delay is caused to the transmission of pressure signals from the pilot servo valve assembly to the two pressure chambers. Thus the main servo valve assembly becomes low in responsiveness and is unable to operate in a suitable manner to handle high frequencies.

Moreover, the great length of the fluid passages of the pressurized fluid inevitably renders the construction of the flow passages complex, and the fluid passages must be formed with a number of holes for machining the valve assembly, with the air being collected in such holes and making it impossible for the valve assembly to achieve the desired performance.

SUMMARY OF THE INVENTION

Accordingly, an object of this invention is to provide a fluid pressure servo valve assembly of the type in which passages for introducing an actuating pressurized fluid from the pilot servo valve assembly to the pressure chambers for driving the power spool member of the servo valve assembly are reduced in length as compared with those of the conventional main servo valve assembly wherein the responsiveness of the fluid pressure servo valve assembly can be increased.

A further object is to provide a fluid pressure servo valve assembly of the type in which the power spool valve member is formed therein with a hollow space so as to reduce the inertia of the power spool valve member and to increase the responsiveness thereof.

A further object is to provide a fluid pressure servo valve assembly of the type in which the axially directed force exerted on the power spool valve member by an actuating fluid flowing from the inlet ports to the outlet ports can be compensated whereby the responsiveness of the valve assembly can be increased.

According to the invention, there is provided a fluid pressure servo valve assembly driven by a pilot servo valve assembly for effecting control of the flow of a fluid flowing at a high flow rate from an actuating pressurized fluid source to apparatus to be driven by the fluid, comprising a valve body formed therein with a cylindrical bore, input port means opening in said cylindrical bore and communicating with the fluid source, output port means opening in said cylindrical bore and communicating with the apparatus to be driven by the fluid, a spool valve member fitted in said cylindrical bore for axial reciprocatory movement so that said input port means can be connected and disconnected with said output port means as the spool valve member moves axially in reciprocatory movement in said cylindrical bore, a sealed space, a piston member connected to said spool valve member and slidably extending into said space to divide the space into two chambers, and communicating means for communicating said two chambers with said pilot servo valve assembly and producing a difference in magnitude between a force exerted by the fluid in one of said two chambers on one of two axial end faces of the piston member and a force exerted by the fluid in the other chamber on the other axial end face of the piston member whereby the spool valve member connected to the piston member can be moved axially in the cylindrical bore for reciprocatory movement.

DESCRIPTION OF THE PRIOR ART (FIGS. 1 AND 2)

To enable the present invention to be better understood, a servo valve system of the prior art will be described with reference to FIGS. 1 and 2.

Figure 1:
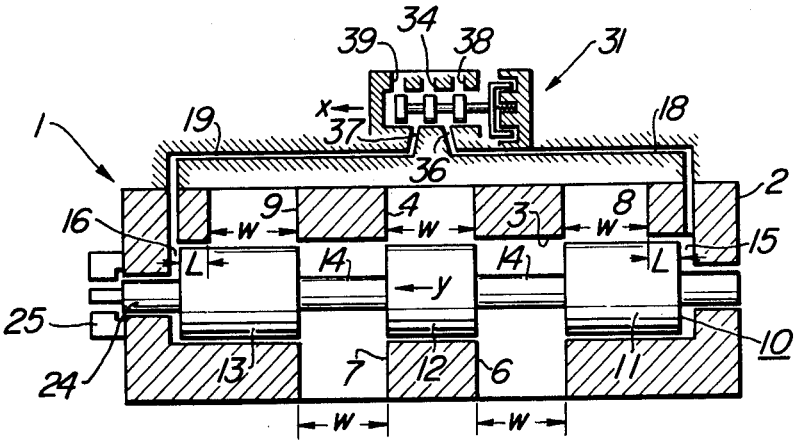
FIG. 1 PRIOR ART
FIG. 1 is a schematic sectional view of a servo valve system of the prior art in its entirety.
Figure 2:
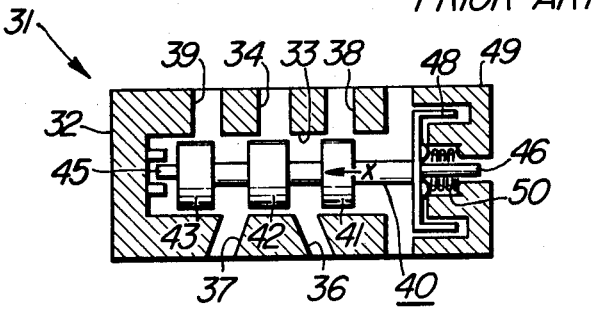
FIG. 2 PRIOR ART
FIG. 2 is a schematic sectional view, on an enlarged scale, of the pilot servo valve assembly shown in FIG. 1.

FIG. 1 is a schematic sectional view bodily showing a two-stage servo valve system of the type in which the spool valve member of a pilot servo valve assembly is directly driven by a force motor, and FIG. 2 is an enlarged sectional view of the pilot servo valve assembly which constitutes the first stage of the servo valve system. Referring to FIGS. 1 and 2, a servo valve assembly constituting the amplifying stage of the system and generally designated by the reference numeral 1 comprises a valve body 2 formed therein with a cylindrical bore 3, an inlet port 4 opening in the cylindrical bore 3 and communicating with a source of actuating pressurized fluid, not shown, first and second outlet ports 6 and 7 opening in the cylindrical bore 3 and communicating with apparatus to be driven, not shown, and first and second tank ports 8 and 9 communicating with a reservoir, not shown. The servo valve assembly 1 further comprises a power spool valve member 10 slidably fitted in the cylindrical bore 3 for axial reciprocatory movement and including axially spaced three lands 11, 12 and 13, the adjacent two lands being interconnected by a neck 14. When the power spool valve member 10 is in the position shown in FIG. 1, the first and second tank ports 8 and 9 are sealed by the end lands 11 and 13 respectively, and the input port 4 is sealed by the center land 12.

First and second pressure chambers 15 and 16 are defined by axial end faces of the power spool valve member 10 and inner faces of end walls of the valve body 2, and communicate with first and second output ports 36 and 37 of the pilot servo valve assembly through passages 18 and 19 respectively. A detector 25 for detecting the speed and displacement of the power spool valve member 10 is attached to an outer surface of one end wall of the valve body 2 in a manner to surround a projection 24 extending axially from the end face of the power spool valve member 10 through an opening formed in the end wall of the valve body 2, to control the movement of the power spool valve member 10.

In FIG. 2, the pilot servo valve assembly generally designated by the reference numeral 31 comprises a valve body 32 formed therein with a cylindrical bore 33, an input port 34 opening in the cylindrical bore 33 and communicating with the source of actuating pressurized fluid, not shown, the first and second output ports 36 and 37, and first and second tank ports 38 and 39 communicating with the reservoir, not shown. The pilot servo valve assembly 31 further comprises a spool valve member 40 fitted in the cylindrical bore 33 for axial reciprocatory movement and including axially spaced lands 41, 42 and 43. When the spool valve member 40 is in the position shown in FIGS. 1 and 2, the first and second tank ports 38 and 39 and the input port 34 are sealed by the lands 41, 43 and 42 respectively. A displacement detector 45 is mounted between a left axial end of the spool valve member 40 and the valve body 32, and a speed detector 46 is mounted between a right axial end of the spool valve member 40 and the valve body 32. Secured to the axial right end of the spool valve member 40 is a force motor 48 which is in spaced juxtaposed relation to a magnet 49 attached to the valve body 32. A spring 50 biases the spool valve member 40 in the axial direction to enable the member 40 to be disposed in a predetermined position.

In the servo valve system of the prior art constructed as aforesaid, if the spool valve member 40 of the pilot servo valve assembly 31 is moved a distance x as by the biasing force of the spring 50 in the direction of an arrow, then the inlet port 34 of the pilot servo valve assembly 32 is connected with the first output port 36 and the pressurized fluid flows from the first output port 36 into the pressure chamber 15 through the passage 18. This causes the power spool valve member 10 to move leftwardly a distance y, and the pressurized fluid in the pressure chamber 16 flows back through the passage 19 and the second output port 37 of the pilot servo valve assembly 31 to the tank port 39 thereof. The leftward movement of the power spool member 10 releases the input port 4 from sealing engagement with the center land 12 and allows the input port 4 to communicate with the first output port 6, so that the actuating pressurized fluid is introduced through the input port 4 and output port 6 into the apparatus to be driven by the fluid.

In this type of servo valve system, it is necessary to effect control of the displacement y of the power spool valve member 10 of the servo valve assembly 1 in a manner to enable the system to respond to high frequencies. Thus the displacement y is detected by the speed-displacement detector 25 in a basic step and the detected value is collated with the instruction received, so as to constitute a servo system. What exerts decisive influences on the response is the natural frequency $f_n$ of the power spool valve member whose value is given by the following equation:

$$f_n=(1/2\pi)\sqrt{(K/m)} \quad (1)$$

where m is the mass of the power spool valve member 10, and the value of K may vary depending on the area S of the pressure chambers 15 and 16, the total fluid volume v in the passages 18 and 19 and the pressure chambers 15 and 16, and the bulk modulus B of the fluid. The value of K is given by the following equation:

$$K=(S^2B/v) \quad (2)$$

It is required in effecting control to keep the value of $f_n$ at a level which is two to three times as high as the frequency which the servo valve system can handle. For example, when the servo system is required to respond to a frequency of up to 100 Hz, the value of $f_n$ should be at least 200 to 300 Hz. The higher the value of $f_n$, the higher is the stability of the control system and higher is the frequency range which can be handled by the system. The value of m which is an important factor in deciding the value of $f_n$ may vary depending on the material of the power spool valve member 10 and the length thereof which is required in order that the member 10 may perform its function.

The area S of the pressure chambers 15 and 16 may vary depending on the driving force which is required. On the other hand, v is given by the following equation:

$$v=S\cdot y_m+S_p\cdot l_p=v_a+v_p \quad (3)$$

where $y_m$ is the necessary maximum stroke of the power spool valve member 10, $S_p$ is the cross-sectional area of the passage 18 or 19, $l_p$ is the length of the passages, $v_a$ is the volume of the pressure chambers, and $v_p$ is the volume of the passages. The value of the first term of equation (3) can be determined as a natural consequence while the value of the second term thereof relate to the passages 18 and 19.

In this type of servo valve system, since the fluid is introduced from the first and second output ports 36 and 37 of the pilot servo valve assembly 31 to the pressure chambers 15 and 16, respectively, which are located at both ends of the power spool valve member 10 of the pressure fluid servo valve assembly 1, the value of the length of the passages $l_p$ is inevitably great and consequently the value of the second term of equation (3) becomes large. It is thus impossible to reduce the value of v and hence the value of $f_n$ becomes small, so that it is impossible to drive the servo valve assembly in a manner to handle high frequencies.

An additional disadvantage of the servo valve system of the prior art is that if the value of the passages of fluid $l_p$ is large, then the fluid passages themselves become complex in construction. Moreover, the fluid passages must be formed with a number of holes for machining the valve assembly, and air is collected in these holes, making it impossible for the valve assembly to achieve the desired performance.

DESCRIPTION OF THE PREFERRED EMBODIMENTS (FIGS. 3-9)

The invention will now be described with reference to the preferred embodiments thereof shown in FIGS. 3-9.

Figure 3:
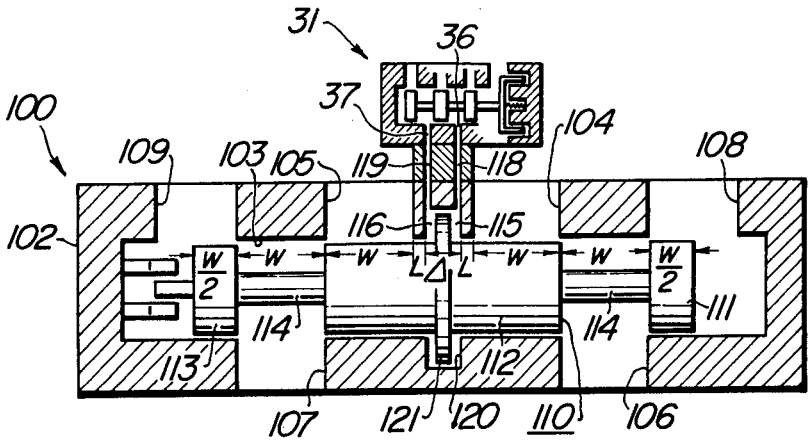
FIG. 3 is a schematic view of the servo valve system in its entirety, having the fluid pressure servo valve assembly comprising one embodiment of the present invention.

FIG. 3 shows, in schematic sectional view, a servo valve system including a pilot servo valve assembly of the piloting stage which is similar to the one shown in FIG. 2, and a servo valve assembly of the amplifying stage according to the present invention which is driven by the pilot servo valve assembly. As shown, the servo valve assembly generally denoted by the reference numeral 100 comprises a valve body 102 formed therein with a cylindrical bore 103, first and second input ports 104 and 105 opening in the cylindrical bore 103 and connected to a source of actuating pressurized fluid, not shown, first and second output ports 106 and 107 opening in the cylindrical bore 103 and connected to apparatus, not shown, to be driven by the pressurized fluid, and first and second tank ports 108 and 109 opening in the cylindrical bore 103 and connected to a tank, not shown. The servo valve assembly 100 further comprises a main spool valve member 110 fitted in the cylindrical bore 103 for axial sliding movement and including axially spaced lands 111, 112 and 113, the adjacent two lands being intereconnected by a neck 114. When the main spool valve member 110 is in the position shown in FIG. 3, the first and second input ports 104 and 105 and the first and second tank ports 108 and 109 are sealed by the center land 112 and the end lands 111, 113 respectively, so as to thereby disconnect the input ports 104 and 105 with the output ports 106 and 107.

The servo valve assembly 100 further comprises an annular recess 120 formed in the peripheral surface of the cylindrical bore 102 of the valve body 102 and interposed between the first and second input ports 104 and 105. The center land 112 has an outer peripheral surface which cooperates with the annular recess 120 to define an annular space. A piston member 121 integrally connected to the outer periphery of the center land 112 extends radially outwardly from its outer peripheral surface into the annular space to divide the same into two annular pressure chambers 115 and 116. One annular pressure chamber 115 communicates with the first output port 36 of the pilot servo valve assembly 31 through a fluid passage 118, while the other annular pressure chamber 116 communicates with the second output port 37 of the pilot servo valve assembly 31 through a fluid passage 119.

In the servo valve assembly constructed as aforesaid according to the invention, the two annular pressure chambers 115 and 116 are disposed in close proximity and separated from each other by the piston member 121. With this arrangement, it is possible to greatly reduce the length of the fluid passages 118 and 119 connecting the pressure chambers 115 and 116 with the output ports 36 and 37, respectively, of the pilot servo valve assembly 31.

The pilot servo valve assembly 31 constituting the piloting stage of the servo valve system is of the same construction as the pilot servo valve assembly shown in FIG. 2, so that the description thereof is omitted.

The operation of the servo valve system shown in FIG. 3 is similar to that of the servo valve system shown in FIG. 1, so that the description thereof is omitted.

As aforesaid, the embodiment described above and shown in FIG. 3 is constructed such that the pressure chambers 115 and 116 of the servo valve system 100 are formed in the peripheral surface of the cylindrical bore 103 of the valve body 102 adjacent the center land 112 of the main spool valve member 110, and the fluid passages 118 and 119 connecting the output ports 36 and 37 of the pilot servo valve assembly 31 with the pressure chambers 115 and 116 respectively are linear. By this arrangement, the fluid passages can have their length greatly reduced, their configuration simplified, and their fabrication facilitated as compared with the fluid passages of the prior art. However, this arrangement makes it necessary to provide the two input ports 104 and 105 on opposite sides of the pressure chambers 115 and 116. That is, there are two input ports in place of one input port in the prior art. This slightly increases the mass of the main spool valve member 110.

The effectiveness of the present invention will be vindicated by comparing the natural frequency $f_n$ of the embodiment shown in FIG. 3 with that of the prior art shown in FIG. 1 by referring to an example.

The width of the ports will be denoted by W and the length of the seal provided by the main spool valve member 10 or 110 will be denoted by L. Only the major diameter portion of the main spool valve member 10 or 110 which come into sliding contact with the side walls of the valve body defining the cylindrical bore 3 or 103 will be considered. In notation, the suffix O will be used for the prior art and the suffix N will be used for the embodiment shown in FIG. 3.

The mass $m_0$ of the main spool valve member 10 of the prior art is given by the following equation:

$$m_0 \propto 3W+2L \tag{4}$$

On the other hand, in the case of the embodiment of FIG. 3, the lands 111 and 113 for controlling the tank ports 108 and 109 respectively may be short in length because there is no need to provide a seal and consequently their length can be reduced. If the length of these lands is assumed to be W/2, the mass $m_N$ is given by the following equation:

$$m_N \propto 3W+2L+\Delta \tag{5}$$

where Δ is the distance between the two pressure chambers 115 and 116. Thus the ratio of the two masses $\sigma_m$ is given by the following equation:

$$\sigma_m = \frac{m_N}{m_0} = \frac{3W+2L+\Delta}{3W+2L}$$

Next, the fluid volume v will be discussed. If only one side of the system is considered, the fluid volume $v_0$ of the prior art can be expressed as follows:

$$v_0 = v_a + (h+b+b')S_p \tag{7}$$

where h is the vertical length from the cylindrical bore 3 to the pressure chamber 15 or 16, b is the horizontal length from the cylindrical bore 3 to the pressure chamber 15 or 16, and b' is the value of length for correction for conversion to a three dimensional arrangement. From FIG. 1, $$b \approx 2.5W+L \tag{8}$$

Accordingly, $$v_0 = v_a + (h+2.5W+L+b')S_p \tag{9}$$

On the other hand, in the embodiment of the invention shown in FIG. 3, the construction of the fluid passages can be very simplified. Therefore, $$v_N = v_a + hS_p \tag{10}$$

Thus the ratio of the two fluid volumes $\sigma_v$ will be written by the next equation:

$$\sigma_v = \frac{v_N}{v_0} = \frac{v_a + hS_p}{v_a + (h+2.5W+L+b')S_p} \tag{11}$$

Meanwhile the natural frequency $f_n \propto \sqrt{(1/m \cdot v)}$, so that the frequency ratio $\sigma_f$ of the two types of assemblies can be expressed by the following equation:

$$\sigma_f = \frac{f_{nN}}{f_{n0}} = \frac{\sqrt{\dfrac{1}{m_N \cdot v_N}}}{\sqrt{\dfrac{1}{m_0 \cdot v_0}}} = \sqrt{\frac{1}{\dfrac{m_N}{m_0} \cdot \dfrac{v_N}{v_0}}} = \sqrt{\frac{1}{\sigma_m \cdot \sigma_v}} \tag{12}$$

Taking a servo valve assembly of a large capacity as an example, concrete figures will be substantuted for the various variants in the aforementioned equations. If W=6 cm., L=2 cm. and Δ=3 cm., then $\sigma_m=1.14$.

Furthermore, if h=25 cm., Sp=3 cm.$^2$, $v_a$=13 cm.$^2$ and b'=10 cm., then $l_{PN}$=25 cm. (=h), $v_N$=88 cm.$^3$, $l_{PO}$=52 cm. and $v_0$=169 cm.$^3$. Accordingly, $\sigma_v=0.52$. Therefore, from equation (11), $\sigma_f=1.3$. It will be seen that the natural frequency $f_n$ of the servo valve assembly of the present invention is higher by no less than 30% than that of the prior art.

In actual practice, however, the influence of the equivalent mass of the fluid in the fluid passages must be taken into consideration. Therefore, actually $\sigma_m=1$ and hence $\sigma_f=1.4$. Thus an increase of about 40% of natural frequency $f_n$ can be obtained with the embodiment of the invention shown in FIG. 3.

Figure 4:
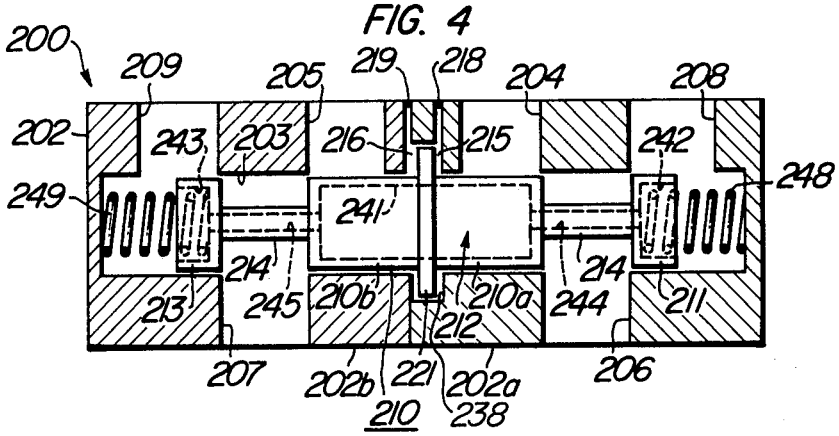
FIG. 4 is a schematic sectional view showing the fluid pressure servo valve assembly comprising a second embodiment of the invention.
Figure 5:
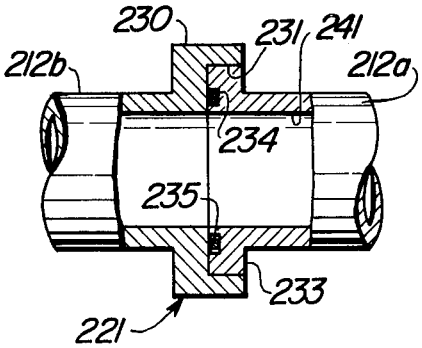
FIG. 5 is a fragmentary sectional view showing in detail the center land of the power spool member shown in FIG. 4.

FIGS. 4 and 5 show a second embodiment of the invention. As shown, a main spool valve member 210 consists of two spool valve portions **210*a* and 210*b* which are coaxially arranged. The spool valve portion 210*a* includes lands 211 and 212*a* disposed on both axial ends thereof and interconnected by a neck 214, and the spool valve portion 210*b* includes lands 213 and 212*b* disposed on both axial ends thereof and interconnected by a neck 214. The lands 212*a* and 212*b* constitute a center land 212**.

As shown in FIG. 5, the land **212*b* is formed integrally at its axial free end with a flange 230 which defines an annular recess 231 at its axial end. The land 212*a* is formed integrally at its axial free end with a flange 233 which fits snugly in the annular recess 231 with the outer peripheral surface of the flange 233 being brought into intimate contact with the inner peripheral surface of the annular recess 231. The flange 233 is formed at its axial free end surface with an annular groove 234 in which an O-ring 235 is mounted for sealing the axial free end surface of the flange 231. In this way, the flanges 230 and 233 constitute a piston member 221**.

In conformity with the formation of the main spool valve member 210 by the two portions **210*a* and 210*b*, a valve body 202 also consists of two portions 202*a* and 202*b*. One valve body portion 202*a* is formed, in an inner peripheral wall of the inner axial end portion thereof juxtaposed against the inner axial end portion of the other valve body portion 202*b*, with an annular recess 238 which is concentric with a cylindrical bore 203. An annular space which is divided into two pressure chambers 215 and 216 by the piston member 221 extending thereinto is defined by the annular recess 238 and the inner axial end face of the other valve body portion 202*b* which is juxtaposed against the inner axial end portion of one valve body portion 202*a*. Like the pressure chambers of the embodiment shown in FIG. 3, the pressure chambers 215 and 216 communicate with the respective output ports of the pilot servo valve assembly through passages 218 and 219** respectively.

By dividing the main spool valve member 210 into the two portions 210*a* and 210*b*, it is possible to form in the center land 212 a hollow space 241 whose size can be increased as much as possible so long as the strength of the center land 212 can permits. Hollow spaces 242 and 243 can also be formed in the end lands 211 and 213 respectively, and hollow spaces 244 and 245 can be formed in the necks 214. Thus it is possible to reduce the mass of the main spool valve member 210 as much as possible.

A compression spring 248 is mounted between one end wall of the valve body portion 202*a* defining the cylindrical bore 203 and the axial end face of the end land 211 defining the hollow space 242, and another compression spring 249 is mounted between the other end wall of the valve body portion 202*b* defining the cylindrical bore 203 and the axial end face of the end land 213 defining the hollow space 243. The two compression springs 248 and 249 bias the main spool valve member portions 210*a* and 210*b* toward each other to prevent the separation of the two portions.

By this arrangement, the two tank ports 208 and 209 communicate with each other through the hollow spaces 241–245 in the main spool valve member 210, so that back pressures on the fluid return sides of the tank ports 208 and 209 balance and no back pressures act on the main spool valve member 210. This feature enables gain errors to be minimized and permits the gain characteristic or responsiveness to be improved.

Thus, in actual practice, it is possible to greatly reduce the size of the spool lands 211 and 213 as compared with the width of the tank ports 208 and 209, thereby allowing a further reduction in the mass of the main spool valve member 210.

Figure 6:
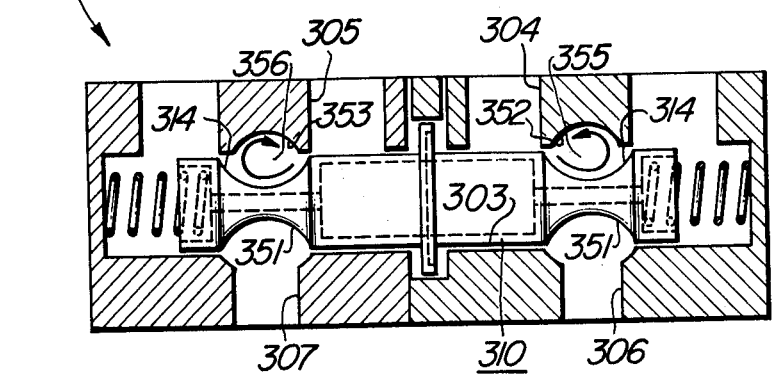
FIG. 6 is a schematic sectional view of the fluid pressure servo valve assembly comprising a third embodiment of the invention.

FIG. 6 shows an improvement in the embodiment shown in FIG. 4. Description of parts in FIG. 6 similar in function to those in FIG. 4 is omitted.

The embodiment shown in FIG. 6 comprises compensating means for compensating for an axial thrust exerted on the main spool valve member 310 by the fluid flowing from one input port to one output port when the first input port 304 is connected to the first output port 306 or the second input port 305 is connected to the second output port 307. The compensating means includes outer peripheral surfaces 351 of the necks 314 interconnecting the lands which outer peripheral surfaces are curved in cross section, and annular recesses 352 and 353 of curved cross-sectional shape formed in the portions of the peripheral surface of the cylindrical bore 303 which is juxtaposed against the necks 314. The curved outer peripheral surfaces 351 of the necks 314 and the curved annular recesses 352 and 353 formed in the cylindrical bore 303 define therebetween annular passages 355 and 356 which communicate with the first and second output ports 306 and 307 respectively. By this arrangement, when the first input port 304 is connected to the first output port 306 or the second input port 305 is connected to the second output port 307, the pressurized fluid passing therethrough flows in a circle as indicated by an arrow in the annular passage 355 or 356, so that no axial thrust acting on the main spool valve member 310 is produced.

Figure 7:
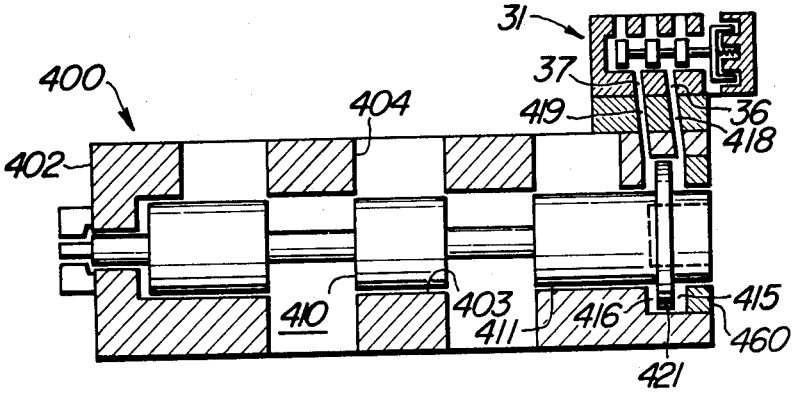
FIG. 7 is a schematic sectional view of the servo valve system having the fluid pressure servo valve assembly comprising a fourth embodiment of the invention.

FIG. 7 shows a fourth embodiment of the invention. Description of parts in FIG. 7 similar in function to those shown in FIG. 3 is omitted. In the servo valve assembly 400 shown in FIG. 7, the piston member 421 is integrally connected to the axial end of one of the end lands 411 of the main spool valve member 410. Accordingly, the pressure chambers 415 and 416 are also formed near the end of the cylindrical bore 403. The pilot servo valve assembly 31 similar to the one shown in FIG. 2 is located above the piston member 421.

In this arrangement, the passages 418 and 419 communicating the first and second output ports 36 and 37 of the pilot servo valve assembly 31 with the pressure chambers 415 and 416 of the fluid pressure servo valve assembly 400 can have their length reduced as is the case with other embodiments. Moreover, this embodiment offers additional advantages in that the valve body 402 is simplified in construction because the number of the inlet ports 404 can be reduced to one, and the cost of production can be reduced.

In the embodiment shown in FIG. 7, the hollow spaces 241–245 shown in FIG. 4 can be formed in the main spool valve member 410. Also, it is possible to divide the main spool valve member 410 into two portions and the springs 248 and 249 can be mounted at both ends of the divided spool valve member as in the embodiment shown in FIG. 4. Moreover, if an end member shown at 460 and having the same diameter as the pressure chambers 415 and 416 is force fitted or threadably fitted in the right end portion of the valve body 402 in a manner to extend radially inwardly into the cylindrical bore 403, it is possible to facilitate insertion into, and removal from, the valve body 402 of the main spool valve member 410.

Figure 8:
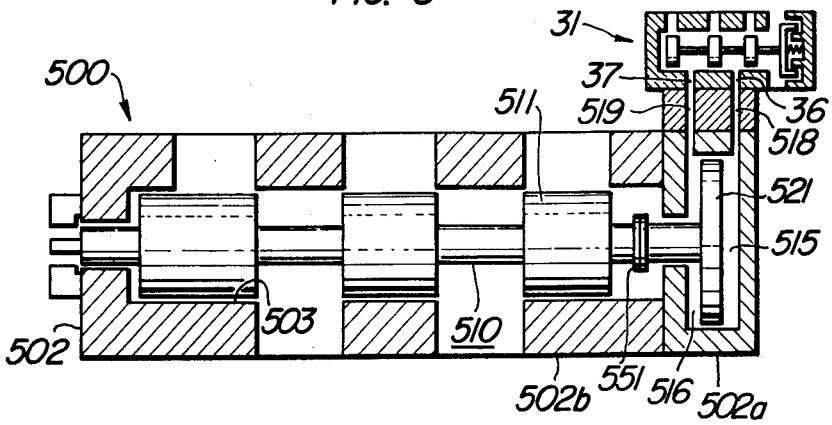
FIG. 8 is a schematic sectional view of the servo valve system having the fluid pressure servo valve assembly comprising a fifth embodiment of the invention.

FIG. 8 shows a fifth embodiment, and description of parts similar in function to those shown in FIG. 3 is omitted. The servo valve assembly generally designated by the reference numeral 500 is constructed such that the piston member 521 is detachably attached to the spool valve member 510 so as to facilitate maintenance and inspection. As shown, the servo valve assembly 500 includes a valve body 502 consisting of two valve body portions 502*a* and 502*b*. One valve body portion 502*b* is formed therein with a cylindrical bore 503 having the spool valve member 510 fitted therein for axial reciprocatory movement.

The other valve body portion 502*a* is formed therein with a hollow space in which the piston member 521 is located for reciprocatory movement axially of the spool valve member 510. The hollow space is divided by the piston member into two pressure chambers 515 and 516, and the end land 111 of the spool valve member 510 is detachably connected to the piston member 521 through a joint 551.

Like the pressure chambers of the embodiment shown in FIG. 3, the pressure chambers 515 and 516 communicate with the output ports 36 and 37 of the pilot servo valve assembly 31 of the same construction as that shown in FIG. 2, through passages 518 and 519 respectively. Description of the operation of this embodiment is omitted because it operates in the same manner as the embodiment shown in FIG. 3.

In the servo valve assembly 500 shown in FIG. 8, the replacement, maintenance and inspection of the spool valve member 510 are facilitated because it can be withdrawn from the cylindrical bore 503 if the valve body portions 502*a* and 502*b* are detached from each other.

Figure 9:
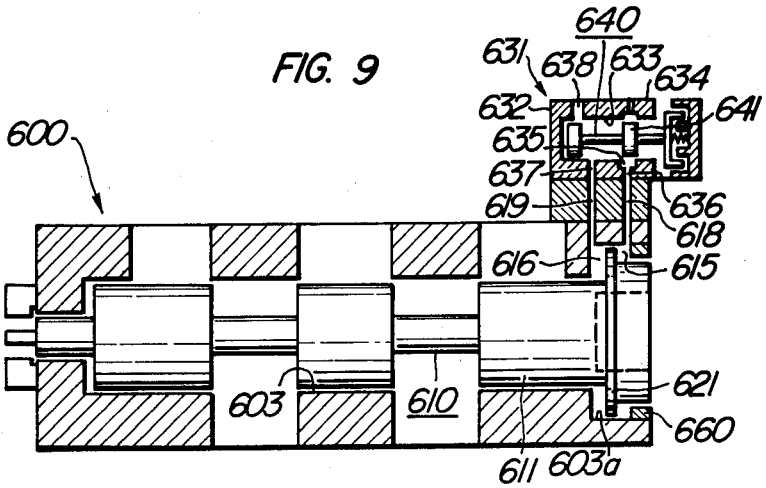
FIG. 9 is a schematic sectional view of the servo valve system including the fluid pressure servo valve assembly according to the invention associated with a pilot servo valve assembly in the form of a three-way valve.

FIG. 9 shows a servo valve assembly 600 comprising another embodiment of the invention which is combined with a pilot servo valve assembly 631 in the form of a three-way valve. As shown, the pilot servo valve assembly 631 comprises a valve body 632 formed therein with a cylindrical bore 633. An annular recess 635 is formed in the cylindrical bore 633, and an input port 634 connected to a source of supply of pressurized fluid, not shown, opens in the annular recess 635. A first output port 636 also opens in the annular recess 635. The pilot servo valve assembly 631 further comprises a tank port 638 and a second output port 637 opening in the cylindrical bore 633. When the annular recess 635 is sealed by a right land 641 of a spool valve member 640, the input port 634 is connected to the first output port 636 through the recess 635.

In the servo valve assembly shown in FIG. 9, the end land 611 of the spool valve member 610 has integrally formed at its axial free end the piston member 621 which is located in an enlarged diameter portion 603*a* of the cylindrical bore 603 having a ring member 660 force fitted or threadably fitted in its open end. The enlarged diameter portion 603*a* and an inner end face of the ring member 660 define therebetween an annular space which is divided by the piston member 621 into the two pressure chambers 615 and 616. The pressure chamber 615 communicates with the first outport port 636 of the pilot servo valve assembly 631 through passage 618, and the pressure chamber 616 communicates with the second output port 637 thereof through passage 619.

An axially right end face of the piston member 621 has an area $\frac{1}{2}$ A which is half the area A of an axially left end face thereof.

When the pilot servo valve assembly 630 is in the position shown in FIG. 9, the input port 634 communicates with the output port 636 through the annular recess 635, so that a pressurized fluid under a pressure P is introduced through passage 618 into the right pressure chamber 615. Owing to the presence of the pressurized fluid in the right pressure chamber 615, a force $F_1$ of a magnitude $\frac{1}{2}$ P·A acts on the right end face of the piston member 621 to bias the spool valve assembly 610 rightwardly. At this time, the pressurized fluid in the left pressure chamber 616 is discharged therefrom through the second output port 637 and tank port 638. Rightward movement of the spool valve member 640 of the pilot servo valve assembly 630 from its position shown in FIG. 9 connects the input port 634 with the second output port 637, so that a pressurized fluid under a pressure P is introduced through passage 619 into the left pressure chamber 616. The pressurized fluid in the right pressure chamber 615 exerts the force $F_1$ of a magnitude $\frac{1}{2}$ P·A on the right end face of the piston member 621, while a force $F_2$ of a magnitude P·A is exerted on a left end face of the piston member 621 by the pressurized fluid in the left pressure chamber 616. Accordingly, a force $F_2-F_1$ which has a magnitude $\frac{1}{2}$ P·A acts on the left end face of the piston member 621, whereby the spool valve member 610 moves rightwardly.

It will be appreciated from the foregoing that the servo valve assembly according to the invention may be combined with a pilot servo valve assembly which may be in the form of a four-way valve or three-way valve as desired.

While the invention has been described with reference to the embodiments of a two-stage servo valve system shown in FIGS. 2 to 9, it is to be understood that the present invention can also have application in servo valve systems of three or more stages.

In the servo valve assembly according to the invention, the pair of pressure chambers are located in adjacent relationship. This arrangement makes it possible to greatly reduce the length of the fluid passages between the pilot servo valve assembly and the pressure chambers, and the reduced length of the fluid passages permits the resposiveness of the servo valve assembly to be increased.

We claim:

1. A fluid pressure servo valve assembly driven by a pilot servo valve assembly for effecting control of the flow of a fluid flowing at a high flow rate from an actuating pressurized fluid source to apparatus to be driven by the fluid, comprising:

a single one piece valve body formed therein with a cylindrical bore having a central axis;

input port means opening in said cylindrical bore and communicating with said fluid source;

output port means opening in said cylindrical bore, being axially spaced from said input port means and communicating with the apparatus to be driven by the fluid;

a single one piece spool valve member including a plurality of integral axially spaced lands of substantially the same diameter as said cylindrical bore, with adjacent lands being interconnected by a neck of a smaller diameter than the lands;

said spool valve member being fitted completely within said cylindrical bore in said single valve body with axially reciprocating movement for bringing said output port means into and out of communication with said input port means;

an annular recess formed in one axial end of said body opening into the peripheral surface of and concentric with said cylindrical bore;

an annular end member having the same outer diameter as said annular recess and the same inner diameter as said cylindrical bore, said end member being sealingly fixed into the one axial end of said valve body to close the corresponding one axial end of said recess and thereby form an annular channel;

one of said lands at the corresponding one axial end of said spool valve member having an outer peripheral surface which cooperates with said body to close said annular channel throughout the axially reciprocating movements of said valve member to define an annular space;

an annular piston member of substantially the same outer diameter as said end member outer diameter, formed integral with said one land and extending outwardly from the outer peripheral surface of said one land into said annular space to divide said annular space into two pressure chambers out of communication with said ports at all times, said two pressure chambers having the same volume in one position of said spool valve member wherein said piston member is centered within said annular space and being disposed adjacent to said pilot servo valve assembly;

said piston member having two axially spaced pressure-receiving faces extending perpendicular to the axis of said cylindrical bore, respectively forming said two pressure chambers, and having the same effective area;

a pair of linearly extending fluid passages of equal length for respectively connecting said two pressure chambers to said pilot servo valve assembly with a minimum distance to introduce the actuating fluid from the pilot servo valve assembly alternately into one and the other of the two pressure chambers for causing the actuating fluid to act alternately on one and the other of said axially spaced pressure-receiving faces of said piston member thereby to reciprocally move said spool valve member in said cylindrical bore; and a pilot servo valve assembly including two outlet ports directly connected to said fluid passages, respectively, control fluid inlet and exhaust ports for receiving and exhausting a control fluid signal, and slide fluid valve means proportioning the control fluid flow between said outlet ports in accordance with the magnitude of the control fluid signal.

2. A fluid pressure servo valve assembly as set forth in claim 1, wherein said one of the lands is a land disposed axially endwardly of said plurality of lands.

3. A fluid pressure servo valve assembly as set forth in claim 1, wherein said spool valve member is formed therein with a hollow space.

4. A fluid pressure servo valve assembly as set forth in claim 1, wherein said lands are each formed therein with a hollow space.

5. A fluid pressure servo valve assembly as set forth in claim 4, wherein said necks are each formed therein with a hollow space.

6. A fluid pressure servo valve assembly claimed in claim 1, wherein said one land has one axial end surface thereof connected to said neck and the other axial end surface being free.

* * * * *